United States Patent [19]

Presz et al.

[11] Patent Number: 4,920,299

[45] Date of Patent: Apr. 24, 1990

[54] PUSH-PULL FLUORESCENT DIMMING CIRCUIT

[75] Inventors: Michael Presz, Dracut; Guy Dela Rosa, Newton, both of Mass.

[73] Assignee: General Electric Company, Burlington, Mass.

[21] Appl. No.: 188,588

[22] Filed: Apr. 27, 1988

[51] Int. Cl.[5] ..... H05B 41/14

[52] U.S. Cl. ..... 315/98; 315/222; 315/219; 315/105; 315/DIG. 5

[58] Field of Search ..... 315/98, 102, 103, 104, 315/105, 219, 222, 306, DIG. 5, 119, 225

[56] References Cited

U.S. PATENT DOCUMENTS

| | | | |
|---|---|---|---|
| 1,844,375 | 2/1932 | Wiegand et al. | 315/289 |
| 1,951,294 | 3/1934 | Greeff | 315/98 |
| 2,008,514 | 7/1935 | Peterson | 315/102 |
| 2,294,623 | 9/1942 | Lebrun | 315/98 |
| 4,327,309 | 4/1982 | Wallot | 315/170 |
| 4,395,659 | 7/1983 | Aoike et al. | 315/209 R |
| 4,716,342 | 12/1987 | McCaffrey | 315/219 |
| 4,791,338 | 12/1988 | Dean et al. | 315/174 |

*Primary Examiner*—Eugene R. Laroche
*Assistant Examiner*—Ali Neyzari
*Attorney, Agent, or Firm*—I. David Blumenfeld; Fred Jacbo; Robert A. Cahill

[57] ABSTRACT

A diming circuit for a hot cathode fluorescent lamp is operated in a push-pull mode whereby the hot filaments are alternately the cathode and the anode. Both filaments thus experience similar degradation with time at all brightness levels, thereby enhancing and lengthening the life of the lamp.

5 Claims, 2 Drawing Sheets

PUSH-PULL FLUORESCENT DIMMING CIRCUIT

SUMMARY OF THE INVENTION

This invention relates to fluorescent lamp power supplies and more particularly, relates to a dimming circuit for hot cathode fluorescent lamps incorporating a power supply functioning in a push-pull mode.

BACKGROUND OF THE INVENTION

When fluorescent lamps are used as light sources for Flat Panel Liquid Crystal Displays, lamp dimming circuitry with a large dimming ratio is required so that the Liquid Crystal Display is readable in ambient lighting conditions which vary from direct sunlight to total darkness.

In the past, dimming circuitry for hot cathode fluorescent lamps incorporated variable frequency/variable duty cycle single ended DC power supplies. The arc supply voltage ionizes the mercury/argon vapor in the fluorescent lamp by energizing the filaments so that one filament acts as the electron emitting cathode electrode. One of the consequences of using single ended DC lamp supplies is uneven filament wear resulting in premature cathode degradation which shortens the life of the fluorescent lamp.

Applicant has found that even filament degradation and increased life for the fluorescent lamps may be realized by providing a symmetrical current through the fluorescent lamp by changing the polarity of the arc voltages applied to the electrodes so that each filament alternately acts as the anode and as the cathode. Both filaments experience similar degradation with time at all brightness levels thereby prolonging lamp life.

OBJECTIVES

It is therefore a principal objective of the instant invention to provide a variable power supply which energizes a hot cathode fluorescent lamp in a push-pull mode.

Another objective of the invention is to operate a hot cathode fluorescent lamp from a variable power supply so that each fluorescent lamp filament functions both as a cathode and an anode.

Yet another objective of the invention is to provide a variable power supply which energizes a hot cathode fluorescent lamp in a manner to provide even degradation of both fluorescent lamp filaments.

Still another objective of the invention is to provide a variable power supply dimming circuit for a fluorescent lamp which operates in a push-pull mode.

Still other objectives and advantages of the invention will be realized as the description thereof proceeds.

BRIEF DESCRIPTION OF THE INVENTION

The push-pull power supply for fluorescent lamp dimming circuit consists of a circuit which provides high voltage D.C. pulses to ionize the mercury/argon vapor in the lamp. Dual outputs from a digital timing means control a pair of switches in the arc voltage power supply for alternately reversing the polarity of the arc supply voltages. One output closes one of the arc supply switches to provide an output arc voltage of a first polarity so that one lamp filament functions as the anode and the other the cathode. When the other output is energized the other switch is closed reversing the Polarity of the output voltage applied to the lamp electrodes so that the fluorescent lamp filaments alternately function as cathodes and anodes.

While the specification includes the claims defining the features of the invention which are regarded as novel, it is believed that the invention, together with further objectives thereof, will best be understood with the following description taken in conjunction with the drawings in which:

DETAILED DESCRIPTION OF THE INVENTION

Figure 1:
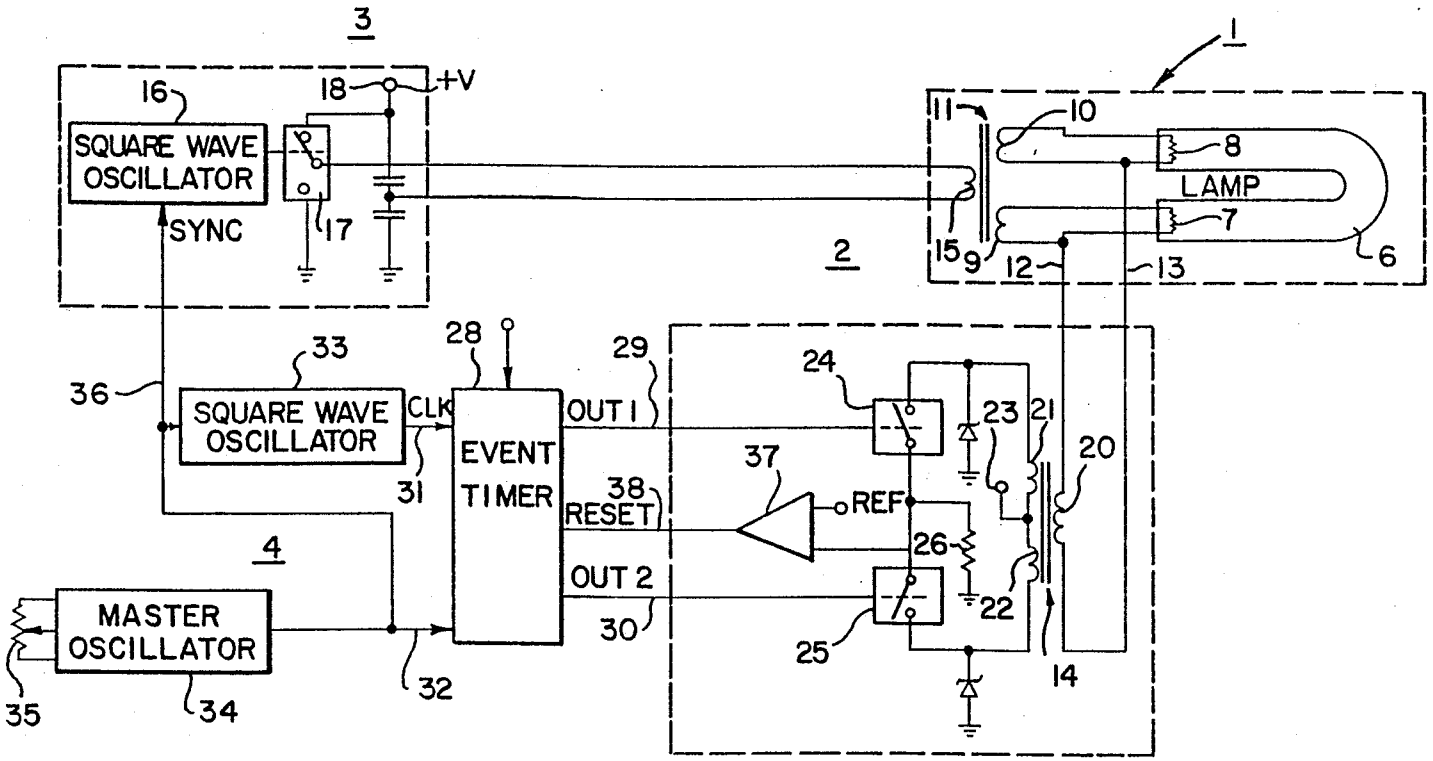
FIG. 1 is a block diagram of a power supply and light dimming control for a fluorescent lamp.

The push-pull power supply and dimming circuit of the invention as illustrated in FIG. 1 consists of a fluorescent lamp light source 1, a push-pull arc voltage power supply 2, a lamp filament supply 3, and a master dimming and timing circuit 4. Timing circuit 4 controls arc voltage supply 2 for operating the fluorescent lamp in a push-pull mode. Timing circuit 4 also contains means for controlling the lamp dimming ratio by adjusting the duty cycle of the output from the arc supply.

Light source 1 is shown as including a U shaped fluorescent lamp 6 although the invention is by no means limited to the U shaped lamps. Lamp 6 contains a pair of filaments 7 and 8 energized from the secondary windings 9 and 10 of a filament heating current supply transformer 11. The primary winding 15 of filament transformer 11 is connected to and energized from the output of filament supply circuit 3. Arc supply voltages for ionizing the mercury/argon vapor are supplied to filaments 7 and 8 through leads 12 and 13 connected to the secondary winding 20 of supply transformer 14 in arc voltage power supply 2.

Filament current supply circuit 3 includes a square wave oscillator 16 coupled to switch 17 which alternately connects the upper end of the filament transformer primary winding 15 between positive supply voltage terminal 18 and ground. For simplicity of illustration, switch 17 is shown as an electro-mechanical device. In actuality it is a bistable solid state switch. The other end of winding 15 is connected to the junction series connected capacitors forming voltage dividers 19. Thus, with the switch in the upper position the upper end of primary winding 15 is at $+V/2$ and the other end, is at $+V/2$ and current flows in one direction through primary 15. With the switch in the lower position the upper end of the transformer winding is connected to ground potential and the lower end to $+V/2$ thus reversing direction of current flow through primary 15.

Arc supply voltage Lines 12 and 13 are connected to secondary winding 20 of transformer 14 operated in a "fly-back" mode to produce high voltage arc pulses to ionize the mercury/argon vapor in the lamp. A positive supply voltage terminal 23 is connected to the junction of a center tapped primary winding. Primary winding sections 21 and 22, are respectively connected to ground through switches 24 and 25 and resistor 26. Depending on the condition of switches 24 and 25 current alternately flows from terminal 23 through winding 21 or through winding 22. That is, with switch 24 closed and switch 25 open, current flows from the positive terminal 23 through winding 21, switch 24 and resistor 26 to ground. With switch 25 closed and switch 23 open, current flows from terminal 23 through winding 22 and switch 25 to ground.

Switches 24 and 25 (which are preferably MOSFETs) are alternately actuated to permit current flow through its associated primary windings section. When the actuated switch is turned off thus interrupting current flow through its associated winding, the magnetic field collapses inducing a high voltage pulse in secondary winding 20 which, depending on its polarity, causes one of the lamp filaments to act as the anode and the other as the cathode. Subsequently, the other switch is turned on and then turned off. Upon turn-off the magnetic field in the other winding collapses inducing another high voltage pulse in the secondary. Because the direction of current flow in the winding sections is opposite, the magnetic direction is reversed as is the polarity of the output voltage at secondary winding 20 thereby causing filaments 7 and 8 to function alternately as anodes and cathodes. Arc voltage supply switches 24 and 25 are for simplicity of illustration, shown as electro-mechanical devices. In actuality, they are preferably solid state MOSFET switches.

Switches 24 and 25 are respectively controlled from the output terminals 29 and 30 of timer 28. Timer 28 has a clock pulse input terminal 31 and a trigger pulse input terminal 32 connected, respectively, to square wave clock pulse generator 33 and a variable repetition frequency trigger pulse oscillator 34. Trigger pulse oscillator 34 is preferably a Voltage Controlled Oscillator (VCO); the pulse repetition frequency (PRF) of which is varied by potentiometer 35 to control dimming of the fluorescent light. That is, as will be pointed out in detail later, in connection with FIGS. 2–8, changing the pulse repetition frequency of the trigger pulses from the VCO varies the duty cycle of the output voltage from arc supply voltage source 2 to control the energy input to the lamp and hence, the brightness of the lamp.

Clock pulse generator 33, trigger pulse oscillator 34 and filament supply square wave oscillator 16 are synchronized by means of the synchronization line 36 so that the positive going leading edges of the square wave pulses from clock pulse oscillator 33 and the pulses from filament supply square wave oscillator 16 are coincidental with the trigger pulse outputs from oscillator 34.

For example, coincidence of a trigger pulse and the positive-going edge of a clock pulse from oscillator 33 sets timer 28 and energizes timer output terminal 29 thereby closing switch 24 in the arc voltage supply. With switch 24 closed current flows through winding 21 to ground. The next positive going clock pulse from the clock pulse generator switches timer 28 and the voltage at output terminal 29 goes to zero opening switch 24 and terminating the flow of current. Termination of current flow as pointed out previously, produces a high voltage output pulse of a given polarity at secondary winding 20. Coincidence of the next trigger pulse from oscillator 34 and a positive going edge of a clock pulse switches timer 28 energizing output 30. This closes switch 25 causing current to flow through winding 22 and resistor 26 to ground. As may be seen from FIG. 1, the direction of current flow through winding 22 is opposite to that through winding 21. Opening of switch 25 at the next positive going edge of a clock pulse, thus produces a high voltage output pulse of the opposite polarity at secondary winding 20. As a result, the filament which was previously the cathode becomes the anode and vice versa.

With each trigger pulse, the output of the timer is switched so that switches 24 and 25 in the arc voltage supply are alternately closed and opened to reverse the polarity of the output voltage from arc supply 4 thereby driving the fluorescent lamps in a push-pull mode.

Figures 2, 3, 4, 5, 6, 7, 8:
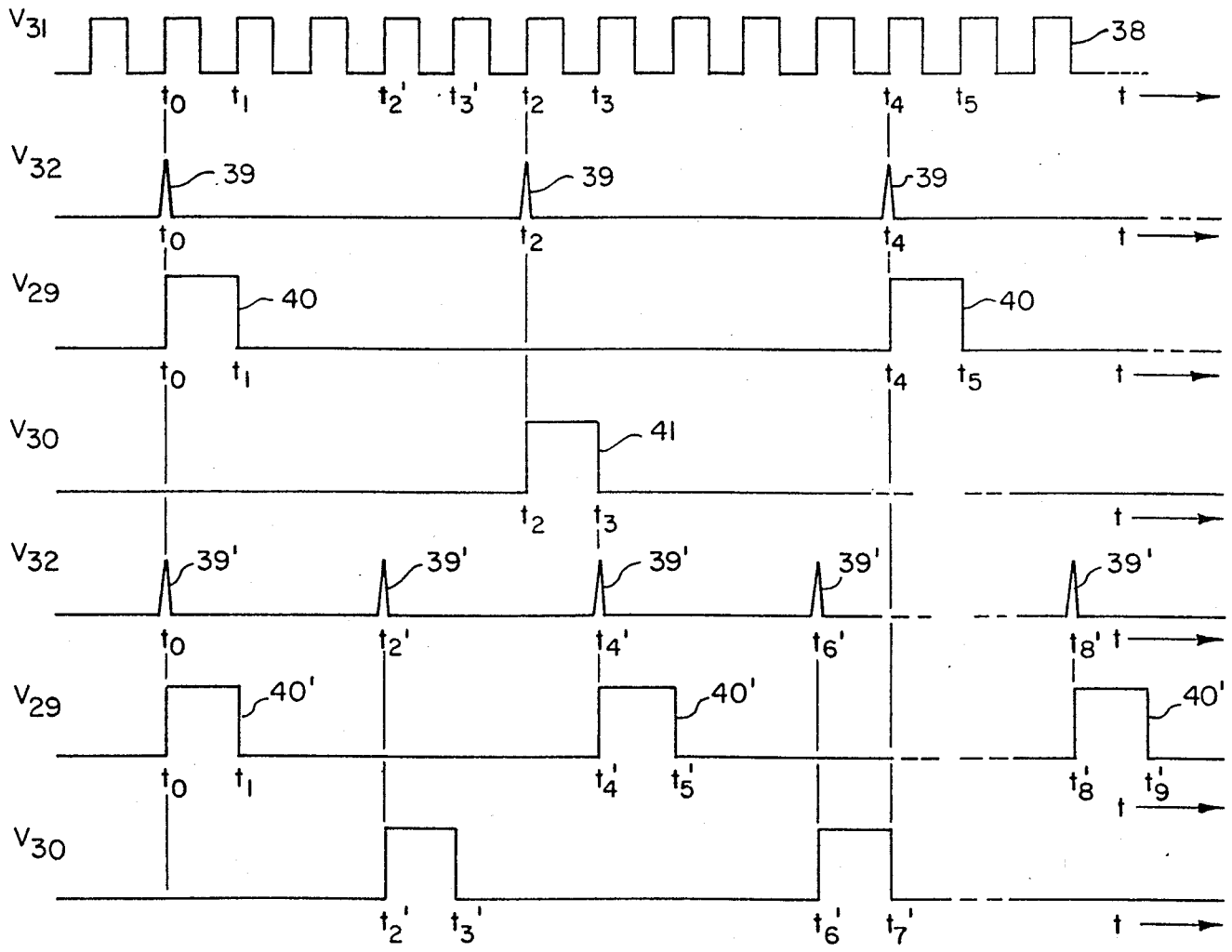
FIGS. 2–8 are wave form diagrams showing the voltages at various points in the circuit of FIG. 1.

FIG. 2 is a wave form diagram illustrating the clock pulses at input terminal 31 of timer 28. FIG. 3 shows the trigger pulses at input terminal 32. FIGS. 4 and 5, respectively, show the output voltages at terminals 29, and 30 and are useful in illustrating operation of the system. FIGS. 6–8 illustrate changes in duty cycle as the pulse repetition frequency rate is varied. In FIGS. 2–8 amplitude is illustrated along the ordinate and time along the abscissa.

FIG. 2 shows a train of clock pulses 38 and FIG. 3 shows a train of triggering pulses 39 from trigger pulse oscillator 34. A $t_0$ coincidence of a positive going edge of clock pulse 38 and the positive trigger pulse 39 actuates timer 28 and as shown in FIG. 3, a positive voltage 40 is present at output terminal 29. Positive output pulse 40 closes switch 24 in the arc voltage supply causing current flow through windings 21. At time $t_1$ the next positive going edge of a clock pulse 38 switches timer 28 terminating the positive output 40 on lead 29. Switch 24 is opened terminating flow of current through transformer winding 21 resulting in a high voltage output pulse of a given polarity across winding 20. At $t_2$ the next trigger pulse switches timer 28 and as shown in FIG. 5 a positive output 41 is produced at output terminal 30 actuating switch 25 in the voltage supply and current now flows through winding 22. At $t_3$ the next positive clock pulse terminates output 41 opening switch 25 and terminating current flow through winding 22. A high voltage pulse of opposite polarity is produced across secondary winding 20 reversing the operational mode of filaments 7 and 8.

As can be seen from FIGS. 2 through 5, the duty cycle of the Push-pull power supply is:

$$\Delta t_1 = \frac{t_3 - t_2}{t_3 - t_1}.$$

where $\Delta t_1$ = duration of the output pulse

By varying the trigger pulse frequency, the duty cycle, as shown in FIGS. 6–8 may be correspondingly varied.

FIG. 6 illustrates a train of the triggering pulses 39′ from oscillator 34 in which (as may be seen by comparison with FIG. 3) the pulse repetition frequency has been increased.

Thus trigger Pulse 39′ at $t_0$ initiates timer 28 to produce a positive output 40′ at terminal 29 to control switch 24 in the power supply. At $t_1$ the positive going edge of next clock pulse terminates the output at terminal 25 thereby opening switch 24 and generating the high voltage output pulse. The next trigger pulse at $t'_2$ triggers timer switch 25 to produce a positive output 41′ at output terminal 30.

At time $t'_3$ the positive going edge of the clock pulse 38 switches timer 28 terminating the positive output voltage at terminal 30 opening switch 25 and producing an output pulse of the opposite polarity.opening switch 25 and producing an output pulse of the opposite polarity. It can be seen that the duty cycle at the new higher frequency PRF is greater than the duty cycle shown in FIGS. 4 and 5. Thus, the duty cycle of the arc voltage supply is controlled by the trigger pulse repetition frequency thereby varying the lamp brightness, i.e., the dimming ratio of the circuit.

A high voltage clamp limits the magnitude of the flyback pulses within safe operating limits of the MOSFET switches. The current limiting network monitors the transformer primary current and a voltage comparator resets the pulse generator when this current exceeds the reference. At higher brightness settings, the reset action of the voltage comparator aids in limiting the maximum power delivered to the lamp and thus, the brightness.

Thus, the inverting input terminal of operational amplifier 37 which acts as a voltage comparator is connected to the junction of switches 24 and 25 with its output connected to reset terminal 38 of timer 28. Whenever the voltage at the inverting terminal; i.e., the voltage drop across resistor 26 which is representative of the current flowing through the windings 21 and 22, exceeds the reference voltage an output signal from the operational amplifier is applied to the reset terminal resetting switch 28 prior to the appearance of the next positive clock pulse. The duty cycle is thus also varied as a function of the current flow or current ramping through the individual primary sections.

It may also be desirable in operating the fluorescent lamp variable power supply to provide a starting arrangement such that the application of the arc voltages to the lamp to ionize mercury argon mixture does not take place until the filament electrodes 7 and 8 have been pre-heated.

In order to obtain maximum operational life from a hot cathode fluorescent lamp, the lamp should not be operated in the cold cathode mode (insufficient heating supplied to the lamp filaments). A preheat timer delays the starting of the arc supply by disabling the pulse generator for 2–3 seconds upon power-up. By delaying the arc supply, the filament supply is given ample time to heat the filaments to operating temperature before the initial high voltage arc pulse is applied to the lamp. In this way, the preheat timer aids in extending lamp life by not operating the lamp in cold cathode mode upon power-up. Also in order to obtain maximum operational life from a hot cathode fluorescent lamp, the lamp filaments should be sufficiently heated at all times. By heating the lamp filaments, the work function of an energizing electron from the filament surface is decreased, thereby lowering the potential drop across the lamp tube required to free the particle and energize the lamp. Excessive voltage across the lamp can otherwise damage the lamp filaments. The filament supply provides isolated voltages to heat the filaments independent of the arc supply.

It will now be understood from the foregoing description that a variable duty cycle arc voltage supply for a hot cathode fluorescent lamp controllably dims the lamp depending on the ambient light conditions while at the same time, operating the fluorescent lamps in a push-pull mode so that the individual filaments alternately function as cathodes and anodes thereby substantially enhancing their life.

While the instant invention has been shown and illustrated by means of a certain preferred embodiment thereof, the invention is by no means limited thereto since other modifications of the instrumentalities may be made still fall within the scope of the invention. It is contemplated by the appended claims to cover any such modifications that fall within the true scope and spirit of the invention.

What is claimed as new and desired to be secured by Letters Patent of the United States is:

1. Variable arc-voltage power supply circuitry for a fluorescent lamp light source comprising:

(a) fluorescent lamp means having a plurality of filament electrodes, (b) a filament current supply source coupled to and heating said lamp filaments, (c) a push-pull DC arc voltage supply for alternately producing arc supply voltage pulses of opposite polarity including switch means coupled between a DC supply and the primary winding of a transformer the secondary winding of which is coupled to said electrodes; said switch means being opened and closed to permit current flow in one direction to generate a voltage pulse of one polarity in said secondary winding and alternately opened and closed to permit current flow in the opposite direction to generate a voltage pulse of the opposite polarity, (d) means for coupling said pulses to said lamp electrodes whereby each of said filament electrodes alternately operates as an anode and as a cathode, whereby both filament electrodes are subject to even wear, (e) dimming means for said lamp means including means for varying the duty cycle of the output pulses from said arc voltage supply to vary lamp brightness.

2. The power supply according to claim 1 wherein said arc voltage supply includes a switched fly-back transformer means for generating the arc voltage output pulses and means for varying the switching rate to vary the duty cycle of said arc voltage output pulses.

3. The power supply according to claim 2 including a D.C. voltage supply and switch means coupled to the primary winding means of said fly-back transformer for alternately connecting and disconnecting said D.C. supply from said primary winding means thereby selectively initiating current flow in opposite direction through said winding means. and interrupting current flow to produce arc voltage output pulses of opposite polarity.

4. A power supply according to claim 3 wherein said primary winding means has two series connected winding sections with said D.C. voltage supply coupled to the junction of said sections, individual switch means connected to said winding sections for alternately initiating and terminating current flow through said winding sections to produce said output pulses of opposite polarity, and control pulse means coupled to said individual switch means for alternately closing and opening said switch means to initiate opening current flow upon closure of an individual switch means and to terminate current flow upon opening of said individual switch means.

5. The power supply according to claim 4 including means to vary the switching control pulse rate to vary the switching rate and the duty cycle of said arc voltage output pulses.

* * * * *